US006616411B2

(12) United States Patent
Sheidler et al.

(10) Patent No.: US 6,616,411 B2
(45) Date of Patent: Sep. 9, 2003

(54) FAN BLADE FOR AGRICULTURAL COMBINE COOLING SYSTEM

(75) Inventors: Alan David Sheidler, Moline, IL (US); Rebecca Ann Frana-Guthrie, Coal Valley, IL (US); Henry Olsen, Davenport, IA (US); Yong Park, East Moline, IL (US); Jackie Norman, East Moline, IL (US); Gary Keys, Port Byron, IL (US)

(73) Assignee: Deere & Company, Moline, IL (US)

( * ) Notice: Subject to any disclaimer, the term of this patent is extended or adjusted under 35 U.S.C. 154(b) by 0 days.

(21) Appl. No.: 10/053,515

(22) Filed: Oct. 25, 2001

(65) Prior Publication Data

US 2003/0082055 A1 May 1, 2003

(51) Int. Cl.[7] ..... F04D 29/38

(52) U.S. Cl. ..... 416/237; 416/223 R; 416/244 R; 416/204 R; 165/71

(58) Field of Search ..... 416/237, 204 R, 416/244 R, 223 R, 228, 235, 236, 203, 197, 189; 165/71, 88

(56) References Cited

U.S. PATENT DOCUMENTS

| | | | | |
|---|---|---|---|---|
| 1,043,830 A | * | 11/1912 | Heath | |
| 1,946,571 A | * | 2/1934 | Briner | |
| 1,968,918 A | * | 8/1934 | Toth | |
| 2,581,873 A | * | 1/1952 | Morrison | |
| 4,046,488 A | * | 9/1977 | Wickham | |
| 4,191,506 A | * | 3/1980 | Packham | 416/91 |
| 4,197,057 A | * | 4/1980 | Hayashi | 416/242 |
| 4,202,655 A | * | 5/1980 | Maloof | 416/237 |
| 4,671,739 A | * | 6/1987 | Read et al. | 416/230 |
| 5,110,261 A | | 5/1992 | Junkin | |
| 5,415,147 A | * | 5/1995 | Nagle et al. | 123/563 |
| 5,482,508 A | | 1/1996 | Redekop | |
| 5,624,234 A | | 4/1997 | Neely | |
| 5,730,583 A | | 3/1998 | Alizadeh | |
| 6,190,134 B1 | | 2/2001 | Hudson | |
| 6,378,322 B1 | * | 4/2002 | Calvert | 62/314 |
| 6,428,277 B1 | * | 8/2002 | Holmes | 416/192 |
| 6,481,233 B1 | * | 11/2002 | Calvert | 62/314 |

OTHER PUBLICATIONS

John Deere (Europe) Drawing entitled "Propeller" #2–37194, circa 1977, Germany (1page)*.

John Deere (Europe) Drawing entitled "Radiator Compartment II, Detailed Page Information" and parts List, date unknown, but believed prior to Oct. 25, 2001 (2pages)*.

* cited by examiner

*Primary Examiner*—Edward K. Look
*Assistant Examiner*—J. M. McAleenan
(74) *Attorney, Agent, or Firm*—Beem Patent Law Firm

(57) ABSTRACT

A passive fan blade for a cooling package for use in an agricultural combine comprises a generally rectangular member having an axis, a central mounting area and two opposed legs, each leg having a middle region, a leading region and a trailing region, the leading and trailing regions being angled toward the downstream direction of intended air flow. The trailing regions increase in width in proportion to distance from the axis, while the leading regions decrease in width in proportion to distance from the axis, whereby the member is impelled to rotate in the direction of the leading edges when air flows past the member. In an assembly, the passive fan blade is mounted via a bearing assembly and mounting hardware onto a hub connected to a bracket. In a cooling package, the passive fan blade assembly is mounted on a frame in close proximity to a face of a radiator or a charge air cooler to provide turbulence thereby minimizing accumulation of chaff, dust and debris in order to maintain cooling efficiency.

21 Claims, 3 Drawing Sheets

FAN BLADE FOR AGRICULTURAL COMBINE COOLING SYSTEM

BACKGROUND OF THE INVENTION

1. Field of the Invention

The present invention is directed to a passive fan blade for a cooling package for use in an agricultural combine, particularly, it relates to keeping faces of a radiator and a charged air cooler clean of debris.

2. Description of the Related Art

An agricultural combine typically includes a cooling package which may include a radiator and a charged air cooler, each of which has a heat exchanger core with an upstream face, mounted into a frame. The cooling package circulates air through a heat exchanger core in the radiator to reject heat from the engine and other working parts of a combine, and through a heat exchanger core in the charged air cooler to cool air compressed in a turbocharger to make it more dense and allow more oxygen to be fed to cylinders of a engine. An agricultural combine provides a unique problem because of the environment it is in. In the hot environment of a combine, it is necessary to circulate a large volume of air through the cores to reject the large amount of heat produced by the engine, and to push as much air into the cylinders to get as much power out of the engine as possible. Because the environment of a combine is filled with dust and chaff, inevitably the dust and chaff will build up on the upstream faces of the heat exchanger cores, blocking a path of air flow. As the upstream faces become more and more blocked, heat transfer efficiency decreases. The decrease in heat transfer efficiency can lead to engine overheating and loss of power.

Previous attempts to alleviate the problem have included attempts to use passive fan blades immediately upstream of the front faces of the heat exchanger cores.

A passive fan blade acts to break up the debris that forms on the face of the core by making the air more turbulent at the face. It is called "passive" because it is not driven by anything other than the passage of air over the blade, the air being drawn by a powered fan on the downstream end of the cooling package. Passive fan blades have included regions that are angled toward the downstream direction of air flow. The angled regions of the fan blades have caused the blades to rotate in response to the air flow.

The addition of passive fan blades has aided in keeping the heat exchanger core faces clean, however, the fan blades have not rotated dependably and reliably and in some cases have failed to rotate altogether. When the blades have rotated, they have not created enough turbulence to keep the upstream faces of the cores clean for a substantial period of time. It has been necessary to clean the cooling package so frequently that a farmer who is harvesting crops would have to stop several times a day to clear out the upstream face of the cooling package.

Although placing passive fan blades in front of the faces of the heat exchanger cores has assisted in the breaking up the debris and keeping the faces clean, the passive fan blades have not dependably and reliably provided enough turbulence to allow a farmer to continually harvest crops for an extended period of time.

Therefore, what is needed is a passive fan blade and system that will create enough turbulence to allow the upstream face of the heat exchanger cores to remain relatively clean for a full day of harvesting.

BRIEF SUMMARY OF THE INVENTION

It is an object of the present invention to provide a passive fan blade for a cooling package for an agricultural combine that will reliably rotate at a predetermined rotational speed and provide enough turbulence to maintain a relative clean upstream face of a radiator and a charge air cooler of the cooling package.

It is another object of the present invention to minimize a clearance distance between a passive fan blade and upstream faces of the radiator and the charge air cooler of the cooling package.

It is another object of the present invention to provide a set of bearings for a passive fan blade that allows the fan blade to spin at the predetermined rotational speed that creates a high turbulence at the upstream faces of the radiator and the charge air cooler for the cooling package.

It is a feature of the present invention to provide a passive fan blade for cleaning upstream faces of a radiator and a charge air cooler for a cooling package of a combine. It has been determined that important factors that establish turbulence on the upstream face of the heat exchanger cores are rotational speed of the passive fan blades, clearance distance from the fan blade to the upstream face of the heat exchanger cores where the smaller the clearance distance, the more turbulence is created, and bearings that allow the fan blade to turn. To accomplish a desired level of turbulence, what is needed is a passive fan blade with a clearance distance as small as possible, a rotational speed that maximizes turbulence, and a set of bearings that maximizes turbulence.

The passive fan blade includes a rectangular-shaped member which has a center, a length and a width where the length is substantially greater than the width, an axis passing perpendicularly through the center of the member, and a mounting area generally at the center of the member. The mounting area has one larger hole for mounting a bearing housing described later, and a plurality of smaller mounting holes for receiving mounting bolts for a bearing assembly described later. The member is defined by two diametrically opposed legs, each with a middle region generally perpendicular to the direction of air flow, a leading region having an edge and a trailing region having an edge. Both the leading regions and the trailing regions are angled toward the downstream direction of airflow with respect to the middle regions, where the angles are between about 15 and about 30 degrees, with a preferred angle being about 20 degrees. The leading regions decrease in width as a distance from the axis is increased until it reaches a minimum width near the distal end of about 3% to about 15% of the total width of the member with a preferred width of the leading region at its minimum being about 11% of the total width of the member. The trailing regions increase in width as a distance from the axis is increased until it reaches a maximum width near the distal end of about 35% to 50% of the total width of the member with a preferred width of the trailing region at its maximum being about 45% of the total width of the member. As air flows past the member, a greater force is imparted on the trailing regions than on the leading regions, causing the fan blade to rotate in the direction of the leading regions.

One or two passive fan blades may be attached to a bracket having an upstream surface, and a downstream surface. Each blade has a corresponding hub that is generally of a cylindrical shape and is attached to the downstream surface of the bracket. A bearing assembly is attached to each hub using a set of mounting hardware, the bearing assembly having a set of bearings, and a bearing housing with a cover. The mounting hardware is also used to attach the bearing assembly to the mounting area of the member of the fan blade. The bearings within the bearing assembly allow the fan blade free rotation as air is passed over the fan blade. Bearing assemblies are chosen so that the fan blades rotate at a predetermined rotational speed, the rotational speed corresponding to a maximum turbulence. Rotational speeds of between about 200 rpm and about 800 rpm have been experimentally determined, with the present embodiment of this fan blade, to be an ideal range of rotational speeds, with a preferred rotational speed of about 400 rpm.

The cooling package of a combine may include a frame having outer walls that define an opening within the frame, a radiator with an upstream face, and a charge air cooler with an upstream face, wherein the radiator and the charge air cooler are mounted within the opening in the frame. Two fan blade assemblies are attached to a frame of the cooling package, the bracket of each fan blade assembly being attached to the frame. One bracket is positioned upstream of the radiator of the cooling package, and one bracket is positioned upstream of the charge air cooler. In one embodiment of the invention, the radiator fan blade assembly has one fan blade and the fan blade assembly of the charge air cooler has two fan blades. There is a clearance between the upstream face of the radiator and the radiator fan blade assembly and clearance distances between the upstream face of the charge air cooler and the charge air cooler fan blade assembly.

In an alternate embodiment of the invention, the radiator fan blade assembly has two fan blades and the charge air cooler fan blade assembly has two fan blades. Clearances for the radiator fan assembly are between the upstream face of the radiator and each fan blade of the radiator fan blade assembly. Clearances for the charge air cooler fan blade assembly are between the upstream face of the charge air cooler and each of the fan blades of the charge air cooler can blade assembly.

The clearances of both embodiments can be between 20 mm and 30 mm, with a preferred clearance of about 25 mm.

DETAILED DESCRIPTION OF THE INVENTION

Figure 4:
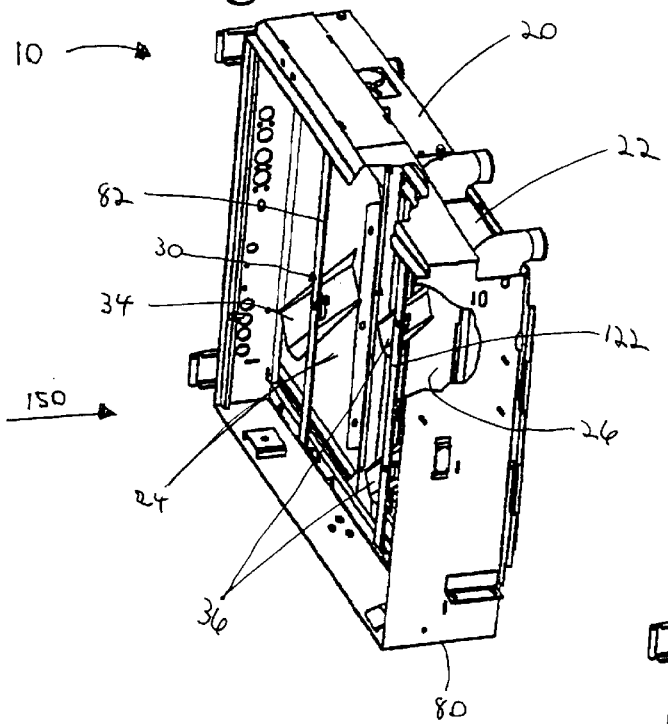
FIG. 4 is a perspective view of the preferred embodiment with one fan blade for the radiator and two fan blades for the charged air cooler.

Referring now to the figures, there is shown a novel and improved cooling package 10 for use in an agricultural combine, see FIG. 4. The inventive cooling package incorporates passive fan blades mounted upstream of a radiator 20 and charge air cooler 22 in order to create added turbulence in air drawn through cooling package 10, the added turbulence created at upstream surface 24 of radiator 20 and upstream surface 26, of charge air cooler 22. The added turbulence advantageously keeps upstream faces 24 and 26 clear of dust and chaff inherent in the environment of an agricultural combine, thereby preventing the blinding over of heat exchanger cores necessary for the operation of combine 14.

Figure 5:
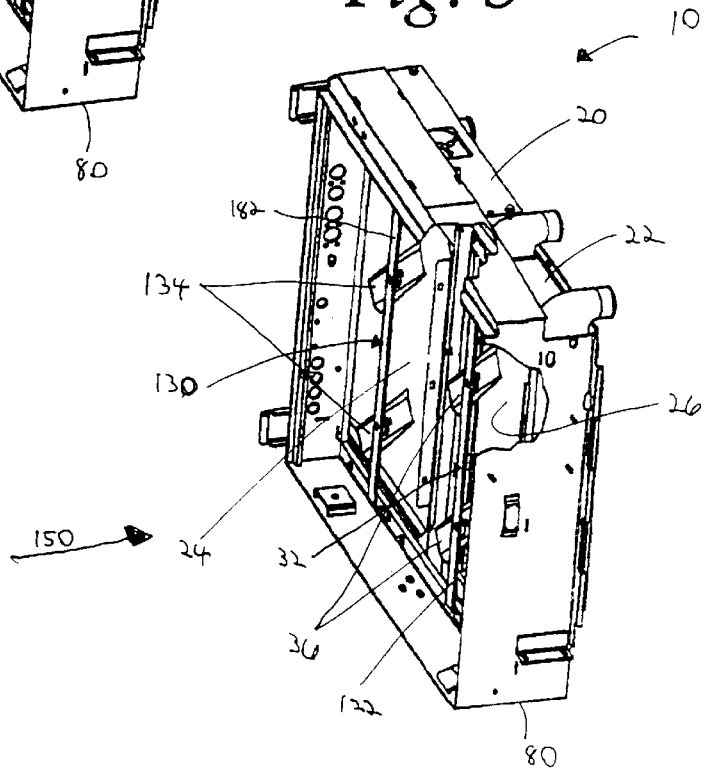
FIG. 5 is a perspective view of an alternate embodiment with two fans for both the radiator and the charged air cooler.

As shown in FIGS. 4 and 5, air is drawn through cooling package 10 by a fan (not shown) in the direction of airflow 150. Cooling package 10 includes a radiator 20 and a charge air cooler 22 combined to form a subassembly as described in copending application with Ser. No. 10/053,514 filed contemporaneously herewith, incorporated by reference as if reproduced in full herein. In the operation of an agricultural combine 10, upstream face 24 of radiator 20 and upstream face 26 of charge air cooler 22 can become covered with dust and chaff from the environment. In the inventive apparatus a passive fan blade assembly 30 is placed upstream of radiator 20 near upstream face 24 of radiator 20 and a passive fan blade assembly 32, is placed upstream of charge air cooler 22 near upstream face 26 in order to create turbulence and prevent accumulation of dust and chaff on radiator face 24 and charge air cooler face 26.

As shown in FIG. 4, radiator fan blade assembly 30 includes one passive fan blade 34. Charge air cooler fan blade assembly 32 is preferred to have two passive fan blades 36. As the fan blades of assemblies 30 and 32 rotate the fan blades keep upstream faces 24 and 26 relatively clear of dust and chaff by increasing turbulence in the air drawn through cooling package 10. The passive fan blades of the invention have been shown to be unexpectedly reliable and dependable in maintaining a desired rotational speed, where the rotational speed was found to be most efficient at clearing faces 24 and 26 in a range of about 200 rpm to about 800 rpm, with a preferred rotational speed of about 400 rpm. When radiator 20 is equipped with fan blade assembly 30 and when charge air cooler 22 is equipped with fan blade assembly 32, upstream faces 24 and 26 remain clean for extended periods of time while a crop is being harvested by combine 12.

It has been surprisingly found that a larger trailing edge and a faster rotational speed of a fan blade does not necessarily relate to more turbulence or result in a cleaner upstream cooling core face. Rather, it was found that the passive fan blade and system of the invention provides a particularly desirable range of rotational speeds that result in maximum turbulence at the face.

The present invention includes a desirable fan blade and system that will rotate at a predetermined rotational speed that has been experimentally found to create a level of turbulence that will keep upstream face 24 and 26 relatively clean for an extended period of time. Fan blade 34 of assembly 30 and fan blades 36 of assembly 32 provide necessary added turbulence at radiator upstream face 24 and charge air cooler upstream face 26. Experimentally determined rotational speeds range from about 200 rpm to about 800 rpm, with a preferred rotational speed of about 400 rpm. Fan blade 34 of radiator fan blade assembly 30 and fan blades 36 of charge air cooler assembly 32 have been designed so that they rotate within the range of rotational speeds of about 200 rpm to about 800 rpm.

Figure 1:
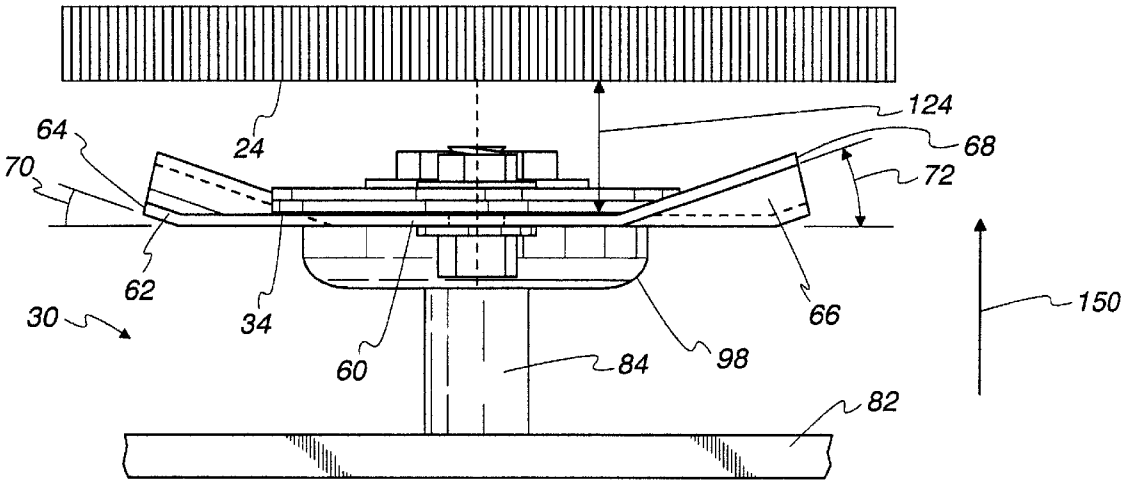
FIG. 1 is a side view of the blade and bracket assembly, and their relationship to the upstream face of a heat exchanger.
Figure 2:
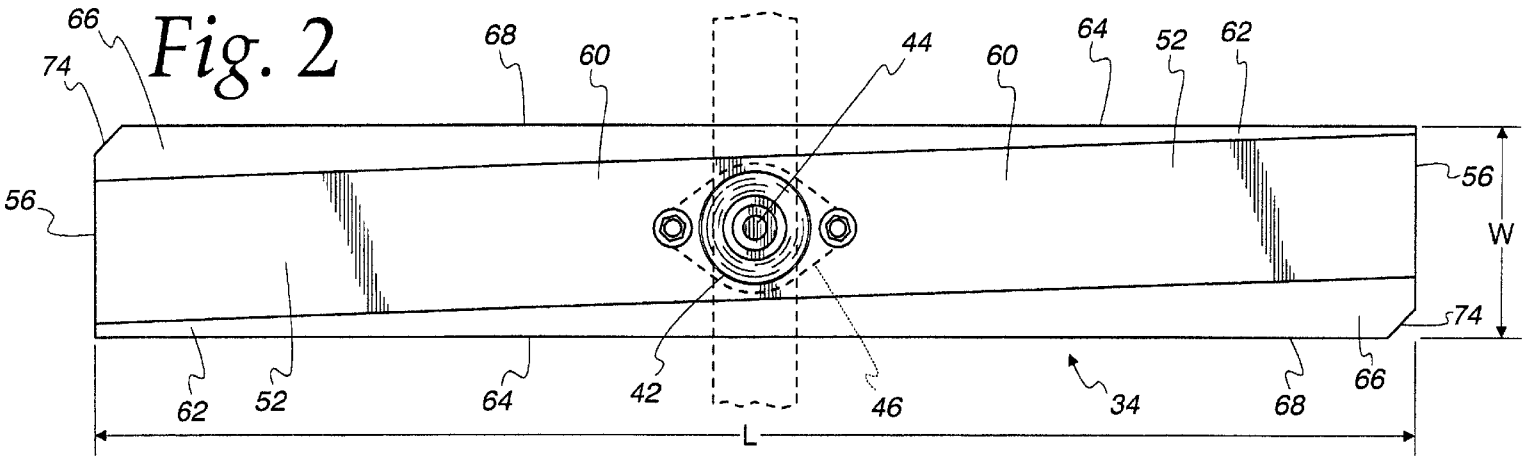
FIG. 2 is a top view of the blade and bracket assembly.

Turning now to FIGS. 1 and 2, fan blade 34 is made up of a rectangular-shaped member of length L and width W, each member having a center 42, an axis 44 passing generally through center 42, a mounting area 46 located generally at center 42 and two diametrically opposed legs 52 with distal ends 56. The length L of fan blade 34 ranges from about 57.5 cm to about 65 cm, with a preferred range of about 59 cm to about 63 cm, and a still more preferred length of about 61 cm. The widths W of fan blade 34 range from about 7.5 cm to about 9.5 cm, with a preferred range of about 8.5 cm to about 9.1 cm, and a still more preferred width of about 8.8 cm. The ratio of the length of to width for fan blade 34 may be between about 6 to 1 and about 9 to 1, with a preferred ratio of between about 6.5 to 1 and about 7.5 to 1, and a still more preferred length to width ratio for fan blade 34 of about 7 to 1.

As best shown in FIGS. 1 and 2, each leg 52 of fan blade 34 has a middle region 60 that is generally perpendicular to airflow direction 150, a leading region 62 with an edge 64 and a trailing region 66 with an edge 68. In a preferred embodiment, leading regions 62. trailing regions 66, and middle regions 60 are substantially planar. Leading regions 62 and trailing regions 66 are both angled toward the downstream direction of airflow. Angle 70 being defined between leading region 62 and middle region 60 and angle 72 being defined between trailing region 66 and middle region 60. Values of between about 15 and about 25 degrees, with a preferred range of between about 18 degrees and about 22 degrees, and a still more preferred angle of about 20 degrees for angles 70 and 72 have been experimentally found to allow fan blade 34 to rotate at the desired rotational speeds of between about 200 rpm and about 800 rpm. A larger angle corresponds to more turbulence created at the face, but a fan blade with a larger angle is less likely to spin because the airflow does not have as much surface area to act upon.

It was expected that a desirable ratio of width of trailing region 66 to the width of leading region 62 would be large, to create a large difference in forces being exerted on the leading region and trailing region. It has been surprisingly found that it is possible to have a width of trailing region 66 that is too wide and a width of leading region 62 that is too narrow, causing the fan blades to fail to rotate. While this phenomenon is not clearly understood, it may be that an overly large trailing edge creates a large resistance to the air through which the trailing edge rotates.

Leading region 62 decreases in width proportional to the distance from center 42 so that it is narrower at distal ends 56. The width of leading region 62 at its minimum ranges between about 3% and about 15% of the overall width of fan blade 34, with a preferred width of the leading region at its minimum being about 11% of the overall width of fan blade 34.

Trailing region 66 increases in width proportional to the distance from center 42 so that it is wider at distal ends 56. The width of trailing region 66 at its maximum ranges between about 35% and about 50% of the overall width of fan blade 34, with a preferred width of the trailing region at its maximum being about 45% of the overall width of fan blade 34.

Because the corners 74 of trailing edges 68 are closer to upstream face 24 than any other portion of the fan blade (best shown in FIG.1), it is desirable to chamfer trailing region edges 68 at corners 74 so that fan blade 34 can be moved closer to upstream face 24 without increasing the risk of fan blade 34 coming in contact with face 24.

The relatively large width of trailing region 66 and the relatively narrow width of leading region 62 causes a force imparted on fan blade 34 by air flowing past fan blade 34 that is larger at trailing region 66, causing the fan blade to rotate in the direction of each leading edge 64 because trailing region 66 has a larger surface area than leading region 62.

Fan blades 36 of charge air cooler fan blade assembly 32 have all the same elements as fan blade 34, except the lengths are different. Lengths of fan blades 36 range from about 38 cm to about 50 cm, with a preferred range from about 41 cm to about 43 cm, and a still more preferred length of fan blades 36 of about 42.5 cm. The ratio of the length of to width for fan blades 36 may be between about 4 to 1 and about 7 to 1, with a preferred ratio of between about 4.5 to 1 and about 5.5 to 1, and a still more preferred length to width ratio for fan blades 36 of about 5 to 1.

As shown in FIG. 4, the present invention incorporates one fan blade 34 of radiator fan blade assembly 30 and two fan blades 36 of charge air cooler fan blade assembly 32 into cooling package 10 to clear dust and chaff off of radiator upstream face 24 and charge air cooler upstream face 26, and to keep the faces relative clear of debris during operation of combine 12 for an extended period of time.

Radiator 20 and charge air cooler 22 are mounted within frame 80 of cooling package 10. Radiator fan blade assembly 30 is mounted to frame 80 immediately upstream of face 24 of radiator 20. Charge air cooler fan blade assembly 32 is mounted to frame 80 immediately upstream of face 26 of charge air cooler 22.

Figure 3:
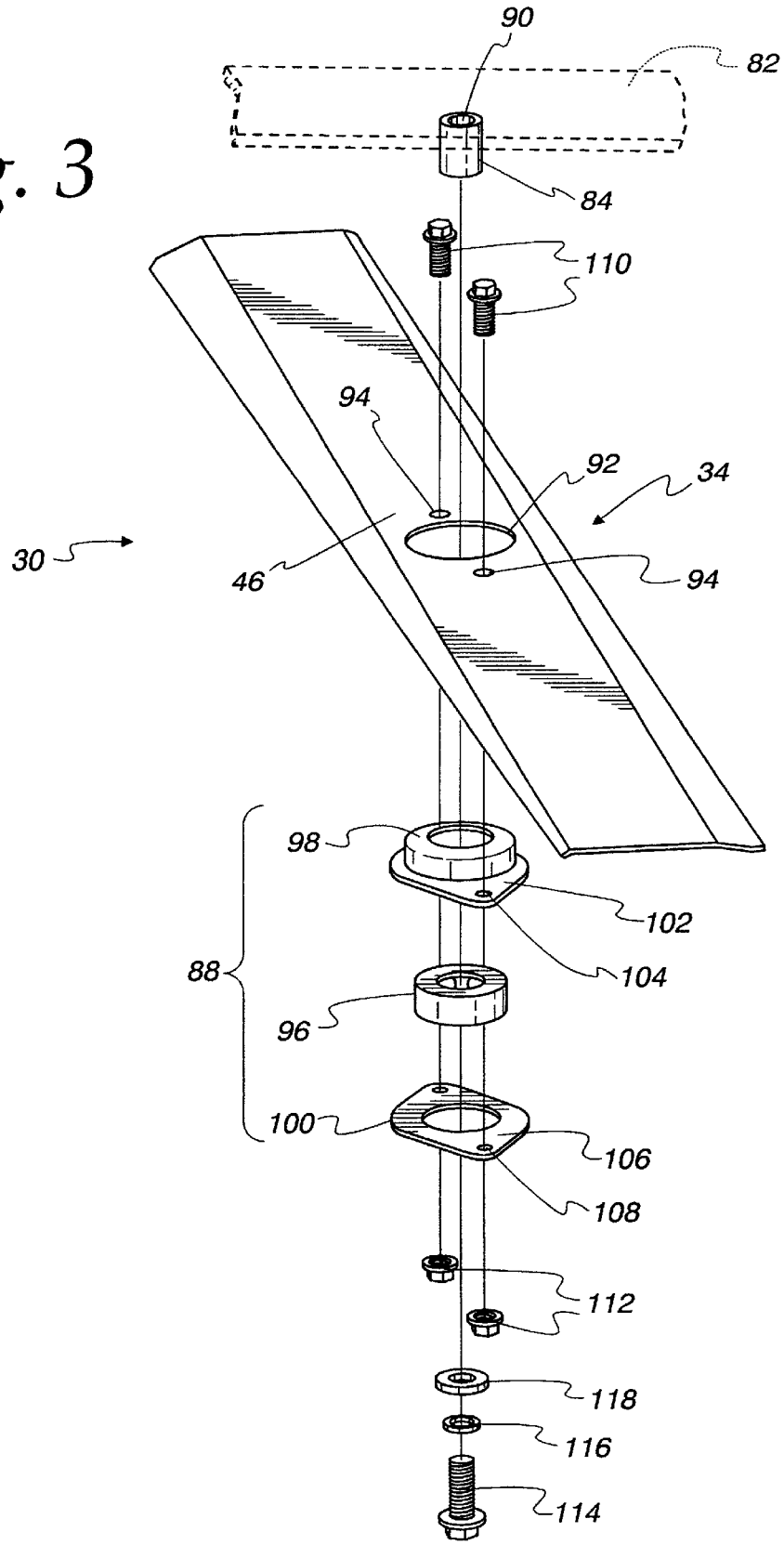
FIG. 3 is an exploded perspective view of the bracket assembly.

Turning to FIG. 3, radiator fan blade assembly 30 includes fan blade 34, a bracket 82, a hub 84, and a bearing assembly 88 as well as hardware to mount bearing assembly 88 to bracket 82 and to fan blade 34. Each bracket 82 has a width large enough so that it is rigid and will not vibrate while the fan blades are rotating, but it also has a width narrow enough so as to not obstruct airflow over fan blade 34. Bracket 82 has a width of about 2 cm to about 5 cm, with a preferred width of about 3 cm.

Hub 84 is attached to the downstream side of bracket 82. Hub 82 includes a mounting hole 90 for the attachment of bearing assembly 88. It is preferred that hub 84 be cylindrical in shape, with a cylinder diameter of between about 0.5 cm and about 2.5 cm with a preferred diameter of about 1 cm.

As shown in the exploded view of FIG. 3, mounting area 46 of fan blade 34 includes a bearing housing hole 92 and a plurality of bearing mounting holes 94 located generally in the center of fan blade 34. Bearing assembly 88 includes a set of bearings 96, a bearing housing 98 and a bearing cover plate 100. Bearing housing 98 has flanges 102 with holes 104 and bearing cover plate 100 has flanges 106 with holes 108. Holes 104 in flange 102 and holes 108 in flanges 106 correspond with bearing mounting holes 94 in fan blade 34.

Mounting hardware that is used for the fan blade assembly includes a set of bearing mounting bolts 110, a set of bearing mounting nuts 112, a hub mounting bolt 114, a lock washer 116, and a washer 118. Bearing mounting bolts 110 and bearing mounting nuts 112 are used to mount bearing assembly 88 to fan blade 34. Bearing mounting bolts 110 extend through bearing mounting holes 94 in fan blade 34, flange holes 104 in bearing housing 98, flange holes 108 in bearing cover plate 100 and engage bearing mounting nuts 112. Bearing assembly 88 and fan blade 34 are mounted to hub 84 on bracket 82 using hub mounting bolt 114, lock washer 116 and washer 118. Hub mounting bolt 114 extends through lock washer 116 and washer 118, through the center of bearing assembly 88 mounted in fan blade 34 and engages mounting hole 90 in hub 84. It is preferred that bearing assembly 88 is generally on the upstream side of fan blade 34. This corresponds to being on the side of fan blade 34 opposite from upstream faces 24 and 26, so that bearing assembly 88 will not come in contact with upstream faces 24 and 26, allowing the fan blade assembly to mounted as close to the faces as possible.

Bearings assembly 88 is important to the rotational speed of fan blade 34. A preferred bearing assembly includes six or seven ball bearings 96, obtainable from a supplier, preferably model #JD29980.

Charge air cooler fan blade assembly 32 includes two fan blades 36, each fan blade having a corresponding bracket, hub, bearing assembly and mounting hardware as described above for fan blade assembly 30 for radiator 20.

Turning to FIG. 4, in a preferred embodiment, radiator fan blade assembly 30 is placed into cooling package 10 by mounting ends of bracket 82 onto frame 80 so that the center of fan blade 34 is generally centered horizontally and vertically with respect to upstream face 24. As seen in FIG. 1, clearance 124 is between the middle region 60 of fan blade 34 and upstream face 24 of radiator 20 is preferred to be as small as possible, but practically there is a limit as to how small the clearance can be, because if clearance 124 is too small, any vibrations could result in fan blade 34 coming in contact with upstream face 24 of radiator 20. Conversely, if clearance 124 is too large, an inadequate amount of turbulence will be created and upstream face 24 will become blinded over with debris such as dust or chaff. A clearance of between about 20 mm and about 30 mm, with a preferred clearance of about 25 mm, has been experimentally determined to be ideal for the present invention.

Charge air cooler fan blade assembly 32 is placed into cooling package 10 by mounting ends of bracket 122 onto frame 80 so that the center of each of fan blades 36 of fan blade assembly 32 are generally centered horizontally with respect to upstream face 26 of charge air cooler 22 and so that one fan blade is generally ⅓of the height of charge air cooler 22 away from the top of frame 80 and one fan blade is ⅓of the height of charge air cooler 22 away from the bottom of frame 80. Clearances between each middle region of fan blades 36 and upstream face 26 of charge air cooler 22 are between about 20 mm and about 30 mm, with a preferred clearance of about 25 mm for the same reasons as stated above.

In an alternative embodiment of the radiator fan blade assembly 130 shown in FIG. 5, two passive fan blades 134 are mounted to radiator bracket 182 similar to the arrangement of fan blades 36 of charge air cooler can blade assembly 32.

Each fan blade 134 of fan blade assembly 130 has the same features of fan blade 34, except the lengths are different. Lengths of fan blades 134 range from about 38 cm to about 50 cm, with a preferred range from about 41 cm to about 43 cm, and a still more preferred length of fan blades 134 of about 42.5 cm. The ratio of the length to width for fan blades 134 may be between about 4 to 1 and about 7 to 1, with a preferred ratio of between about 4.5 to 1 and about 5.5 to 1, and a still more preferred length to width ratio for fan blades 134 of about 5 to 1.

Fan blade assembly 130 has all of the same elements as fan blade assembly 30, except that there are two fan blades 134 instead of one fan blade 34, two corresponding hubs instead of one, two sets of bearing assemblies, and two sets of mounting hardware to mount the fan blades 134 to bracket 180. Except for the length of fan blades 134, all dimensions of fan blade assembly 130 are the same as the dimensions of fan blade assembly 30.

Fan blade assembly 130 is placed into cooling package 10 by mounting ends of bracket 182 onto frame 80 so that the center of each fan blade 134 of fan blade assembly 130 are generally centered horizontally with respect to upstream of face 24 of radiator 20 and so that one fan blade is generally ⅓of the height of radiator 20 away from the top of frame 80 and one fan blade is generally ⅓of the height of radiator 20 away from the bottom of frame 80. Clearances between each middle region of fan blades 134 and upstream face 24 of radiator 20 are between about 20 mm and about 30 mm, with a preferred clearance of about 25 mm for the same reasons as stated above.

The present invention should not be limited to the above-described embodiments, but should be limited solely by the following claims.

What is claimed is:

1. A passive fan blade for a cooling package for use in a combine, comprising:

a generally rectangular-shaped member having a center and having a length and a width, the length being substantially greater than the width;

the member having an axis passing generally perpendicularly through the member at approximately the center of the member;

a mounting area being located generally at the center of the member;

the member comprising two diametrically opposed legs terminating in distal ends;

each leg having a middle region generally perpendicular to intended air flow, a leading region having an edge and a trailing region having an edge, the leading and trailing regions both being angled toward downstream direction of air flow;

wherein each trailing region generally increases in width along the length of the member until the trailing region width reaches a maximum of about 35% to about 50% of the total width of the member near each distal end;

wherein each leading region generally decreases in width along the length of the member until the leading region width reaches a minimum of about 3% to about 15% of the total width of the member near each distal end;

whereby the member is impelled to rotate in the direction of each leading edge when air flows past the member and imparts a larger force on each trailing region than on each leading region.

2. The passive fan blade of claim 1, wherein each trailing region width reaches a maximum of about 45% of the total width of the member near the distal end.

3. The passive fan blade of claim 1, wherein each leading region width reaches a minimum of about 11% of the total width of the member near the distal end.

4. The passive fan blade of claim 1, wherein each trailing edge is chamfered at the distal end.

5. The passive fan blade of claim 1, wherein each region is substantially planar and the middle regions combine to form a generally parallelogram-shaped area.

6. The passive fan blade of claim 5, wherein each angled planar region is angled at about 15 to about 30 degrees from the middle planar regions.

7. The passive fan blade of claim 5, wherein each angled planar region is angled at about 20 degrees from the middle planar regions.

8. The passive fan blade of claim 5, wherein each angled planar region is angled at substantially the same angle from the middle planar regions.

9. The passive fan blade of claim 1, wherein the member is stamped from of a single sheet of metal.

10. A passive fan blade assembly for use in a cooling package for a combine, comprising:

a bracket with an upstream face, a downstream face, and a width;

a hub attached to a face of the bracket;

a fan blade subassembly comprising a passive fan blade, a bearing assembly and mounting hardware;

the passive fan blade including a generally rectangular-shaped member having a center, a length and a width, the length being substantially greater than the width;

the member having an axis passing generally perpendicularly through the member at approximately the center of the member;

a mounting area being located generally at the center of the member, the mounting area including a bearing mount;

the member comprising two diametrically opposed legs terminating in distal ends;

each leg having a middle region generally perpendicular to intended air flow, a leading region having an edge and a trailing region having an edge, the leading and trailing regions both being angled toward downstream direction of air flow;

wherein each trailing region generally increases in width along the length of the member until the trailing region width reaches a maximum of about 35% to about 50% of the total width of the member near each distal end;

wherein each leading region generally decreases in width alone the length of the member until the leading region width reaches a minimum of 3% to 15% of the total width of the member near each distal end;

the bearing assembly comprising bearings and a bearing housing;

wherein the fan blade subassembly is mounted on the hub with the mounting hardware that connects the bearing assembly to the hub and to the bearing mount of the member;

whereby the member is impelled to rotate in the direction of each leading edge when air flows past the member and imparts a larger force on each trailing region than on each leading region.

11. The passive fan blade assembly of claim 10, wherein each angled region of the member is angled at substantially the same angle from the middle region, the angle being selected to obtain a predetermined rotational speed of the passive fan blade.

12. The passive fan blade assembly of claim 10, wherein the bearing assembly is selected to obtain a predetermined rotational speed of the passive fan blade.

13. The passive fan blade assembly of claim 10, wherein rotational speed of the passive fan blade is between about 200 rpm and about 800 rpm.

14. The passive fan blade assembly of claim 10, wherein rotational speed of the passive fan blade is about 400 rpm.

15. The passive fan blade assembly of claim 10, wherein two hubs are attached to a face of the bracket and two fan blade subassemblies are provided, each fan blade subassembly being mounted on its corresponding hub.

16. A cooling package for a combine, comprising a frame, having outer walls that define an opening;

a radiator having an upstream face;

a charge air cooler having an upstream face;

wherein radiator and charge air cooler are mounted within the opening of the frame;

a passive fan blade assembly for the radiator having a bracket, a hub and a fan blade subassembly, wherein there is a clearance between the upstream face of the radiator and the fan blade subassembly, a passive fan blade assembly for the charge air cooler having a bracket, two hubs and two fan blade subassemblies, wherein there is a clearance between the upstream face of the charge air cooler and each fan blade subassembly;

each bracket being mounted to the frame and having an upstream face, a downstream face, and a width;

each fan blade subassembly comprising a passive fan blade, a bearing assembly and mounting hardware;

the passive fan blade having a generally rectangular-shaped member having a center, a length and a width, the length being substantially greater than the width;

the member having an axis passing generally perpendicularly through the member at approximately the center of the member;

a mounting area being located generally at the center of the member, the mounting area including a first mounting hole and a plurality of second mounting holes;

the member comprising two diametrically opposed legs terminating in distal ends;

each leg having a middle region generally perpendicular to intended air flow, a leading region having an edge and a trailing region having an edge, the leading and trailing regions both being angled toward downstream direction of air flow;

wherein each trailing region generally increases in width along the length of the member until the trailing region width reaches a maximum of about 35% to about 50% of the total width of the member near each distal end;

wherein each leading region generally decreases in width along the length of the member until the leading region width reaches a minimum of about 3% to about 15% of the total width of the member near each distal end;

the bearing assembly comprising bearings, and a bearing housing;

wherein each fan blade subassembly is mounted to its corresponding hub with mounting hardware that connects the corresponding bearing assembly to the corresponding hub and to the bearing mount of the member of the passive fan blade in the fan blade assembly;

whereby the member is impelled to rotate in the direction of each leading edge when air flows past the member and imparts a larger force on each trailing region than on each leading region.

17. The cooling package of claim 16, wherein the passive fan blade assembly for the radiator has two hubs attached to a face of the bracket and two fan blade subassemblies are provided, each fan blade subassembly being mounted on its corresponding hub.

18. The cooling package of claim 16, wherein the clearance between the upstream face of the radiator and the radiator fan blade subassembly is between about 20 mm to about 30 mm.

19. The cooling package of claim 16, wherein the clearance between the upstream face of the radiator and the radiator fan blade subassembly is about 25 mm.

20. The cooling package of claim 16, wherein the clearance between the upstream face of the charge air cooler and the charge air cooler fan blade subassembly is between about 20 mm to about 30 mm.

21. The cooling package of claim 16, wherein the clearance between the upstream face of the charge air cooler and the charge air cooler fan blade subassembly is about 25 mm.

* * * * *

UNITED STATES PATENT AND TRADEMARK OFFICE

CERTIFICATE OF CORRECTION

PATENT NO. : 6,616,411 B2
DATED : September 9, 2003
INVENTOR(S) : Alan David Sheidler et al.

It is certified that error appears in the above-identified patent and that said Letters Patent is hereby corrected as shown below:

Column 8,
Line 63, "of" should be deleted.

Column 9,
Line 27, "alone" should read -- along --.

Signed and Sealed this

Ninth Day of December, 2003

JAMES E. ROGAN
*Director of the United States Patent and Trademark Office*